United States Patent [19]

Billings et al.

[11] 4,309,397

[45] Jan. 5, 1982

[54] PRODUCTION OF CARBON MONOXIDE FROM CARBON

[75] Inventors: William G. Billings; James Scinta, both of Bartlesville, Okla.

[73] Assignee: Phillips Petroleum Company, Bartlesville, Okla.

[21] Appl. No.: 172,784

[22] Filed: Jul. 28, 1980

[51] Int. Cl.[3] ..... C10J 3/06; C10J 3/54

[52] U.S. Cl. ..... 423/415 A; 48/197 R; 48/210; 252/373; 423/622

[58] Field of Search ..... 48/197 R, 202, 206, 48/210, DIG. 4; 252/373; 44/10 R, 10 C, 10 E, 10 S, 51; 423/415 A, 622, 623, 99

[56] References Cited

U.S. PATENT DOCUMENTS

| | | | |
|---|---|---|---|
| 799,743 | 9/1905 | Mackay . | |
| 2,342,368 | 2/1944 | Quemeau | 75/26 |
| 2,592,377 | 4/1952 | Bau et al. | 48/206 |
| 2,607,809 | 8/1952 | Pitzer | 136/83 |
| 4,065,544 | 12/1977 | Hamling | 423/99 |
| 4,193,769 | 3/1980 | Cheng et al. | 41/51 |

*Primary Examiner*—Peter F. Kratz

[57] ABSTRACT

A process for the gasification of solid carbon comprising heating under suitable conditions a feed comprising finely divided particles formed by admixing finely divided particles of solid carbon with a slurry of zinc nitrate, removing enough of the liquid of said slurry to give a solid product, calcining said solid product at a temperature no greater than about 550° C. to convert a substantial portion of the zinc material to zinc oxide, and then comminuting the calcined material to the desired particle size.

10 Claims, No Drawings

PRODUCTION OF CARBON MONOXIDE FROM CARBON

This invention relates to the gasification of carbon sources such as coal, char, coke, and the like.

BACKGROUND

In the gasification of solid carbon containing materials such as coal and char, it has been found economically advantageous to employ metal oxide to provide at least part of the oxygen required. Such techniques are disclosed in U.S. Pat. No. 2,592,377 and U.S. Pat. No. 2,602,809, the disclosures of which are incorporated herein by reference.

The effectiveness of such processes is dependent generally upon the size of the carbon particles, the size of the metal oxide particles, and the degree of contact between the metal oxide and the carbon particles during the oxidation. It has been found that when the particles of carbon and the particles of metal oxide are employed as separate distinct particles segregation tends to occur, either in the reactor or during conveyance to the reactor. Such segregation has an adverse effect upon conversion due to a reduction in the extent of contact between the carbon and the metal oxide. The segregation can also interfere with the flow of the materials in the solids conveying equipment.

THE INVENTION

An object of the present invention is to provide a process for the gasification of normally solid carbon using zinc oxide wherein the degree of contact between the carbon and the metal oxide is improved.

Another object of the present invention is to provide a process for improving the amount of carbon monoxide that can be produced from a carbon source.

Still another object of the present invention is to provide a process for producing a free flowing finely divided zinc oxide-containing carbon feed particularly suitable for the gasification of carbon.

These and other objects, aspects, and advantages will be apparent to those skilled in the art from the following disclosure.

In accordance with the present invention, a process is provided for the gasification of solid carbon comprising heating under suitable conditions a feed comprising finely divided particles formed by admixing finely divided particles of solid carbon with a liquid slurry of zinc nitrate, removing enough of the liquid of said slurry to give a solid product, calcining said solid product to convert a substantial portion of the zinc material to zinc oxide, and then comminuting the calcined material to the desired particle size.

The solid carbon sources used in the present invention are those carbonaceous materials which are solid at temperatures of 20° C. Examples of such carbon sources are coal, coke, char, tar sand, peat, oil shale, lignin, rubber scrap, and the like. The term rubber scrap is intended to include such materials as vehicle tires. The present invention is particularly well suited for those solid carbon sources that are solid under temperatures of up to 2500° F. (1373° C.).

The process of this invention can be advantageously used to gasify and convert to carbon monoxide even those solid carbon sources that are solid residues from other gasifications or liquefactions of carbon sources such as coal, oil shale, and residual oil. Examples of coal pyrolysis processes resulting in a solid char residue are the COED processes (developed by FMC Corp.), the Garrett process, the Synthane process, and the Toscoal process. Under one aspect of the present invention, char is the preferred solid source for the process of the invention.

The size of the carbon particles employed can vary over a wide range with best results being obtained with smaller particles. Generally then for best results, the particles should have a maximum dimension no greater than 0.4 mm. Preferably substantially all of the particles are of such size that they will pass through a 20 U.S. sieve. Smaller particles such as those passing through a 200 U.S. sieve are also suitable.

The volatile liquid used in making the slurry can include any suitable liquid which can be readily removed under atmospheric pressure at reasonably low temperatures, for example, preferably temperatures no greater than about 100° C. The presently preferred volatile liquid is water.

In one preferred embodiment, the desired amount of zinc is provided by adding zinc oxide to nitric acid. When all of the zinc oxide is in solution, the carbon is then added. The mixture is heated to reduce the volume and calcined at up to about 550° C. The gases driven off during heating, including $NO_2$ and $H_2O$, can be used to reform nitric acid for later use.

The amount of liquid used to make the slurry can vary widely, but since it will be subsequently removed, it is of course generally preferable to use only that amount necessary to obtain a substantially uniform distribution of the zinc nitrate and the carbon particles. If desired, one can use surfactants, such as glycols, alcohols, acids, etc., to assist in obtaining a relatively uniform distribution.

The calcined product is then agitated, ground, crumbled, or otherwise comminuted into particles of a size suitable for the gasification reaction. Generally, it is preferable if the particles of feed have a maximum dimension of no more than about 0.4 mm. Generally, it is desirable for substantially all the particles to be of such size that they will pass through a 20 U.S. sieve. Smaller particles such as those passing through a 200 U.S. sieve are also suitable.

The amount of zinc nitrate employed can vary over a wide range. In most cases, it is used in such an amount that there will be about 0.05 to about 20 pounds of carbon per pound of zinc oxide. Preferably, however, enough zinc nitrate is employed so that when it is converted to zinc oxide it will provide at least as many available oxygen atoms as there are available carbon atoms. Thus preferably, the zinc nitrate is employed in such an amount that the weight of zinc therein is at least equal to the weight of the carbon.

The gasification reaction can be carried out using any suitable techniques known in the art. In general this involves exposing the particles to temperatures under which the metal oxide can oxidize the carbon. Generally the reaction temperature will be in the range of about 1700° F. to about 2800° F. (928° C. to 1540° C.), preferably about 1832° F. to about 2192° F. (1000° C. to 1200° C.).

The reactions involved are believed to be generally solid/solid reactions so that the pressure is not particularly critical. Pressures in the range of about atmospheric to about 650 psig are generally satisfactory. Generally, however, it is preferred for the pressure to be slightly above atmospheric pressure, i.e., in the range of about 0.1 to about 50 psig (102–446 kPa).

Although it is within the scope of the present invention to conduct the gasification reaction on fixed beds of the prepared particles, it is preferred to agitate the particles relative to each other during the reaction. A particularly preferred process involves the use of gas to maintain the particles in a fluidized state during the reaction. Examples of suitable gases for fluidization include steam and carbon monoxide. The use of carbon monoxide is preferred, especially carbon monoxide provided by recycled portions of the effluent from the gasification reaction.

An alternative preferred embodiment of preparing the feed in accordance with the present invention involves employing ammonium hydroxide in combination with the zinc nitrate. The ammonium hydroxide is added in an amount sufficient to form a gel of the materials in the slurry. The ammonium hydroxide can be added either before or after the carbon is added to the liquid. Preferably, the moles of ammonium hydroxide employed are about the same as the moles of zinc nitrate.

In this embodiment preferably liquid is removed from the basified mixture by vacuum filtration. The filter cake, i.e., gel, is washed with water to remove substantially all of the ammonium nitrate, then dried and calcined.

The following examples will provide further illustration of the present invention and its utility.

EXAMPLE I

A feed was prepared by dissolving 428 grams of zinc nitrate hydrate (i.e., somewhere in the range of about 1.44 to about 1.76 moles of zinc nitrate) in water. Ammonium hydroxide was added to the point of precipitation. Then 23 grams of COED char was added. While this slurry was stirred additional ammonium hydroxide was added to make the slurry slightly basic.

The mixture was then filtered in vacuo and the filter cake that was recovered was washed with 2 liters of water. The cake (or gel) was dried in a fluid bed dryer with an air flow at 80° C. for 30 minutes. About half of the remaining material was calcined for four hours at 850° F. The calcined material was sieved to obtain particles in the range of 20 to 100 U.S.S. mesh.

The other half of the material was calcined for four hours at 850° F. and sieved to obtain particles smaller than 20 U.S.S. mesh.

The batches of sieved particles were combined to give 73.3 grams of feed. An elemental analysis of this feed revealed 14.04 weight percent carbon, 0.43 weight percent hydrogen, 0.51 weight percent nitrogen, 0.53 weight percent sulfur, and 61.4 weight percent zinc.

The feed was fed to a reactor preheated to 1100° C. at ambient pressure. The feed rate was about 15 grams per hour. The average contact time for particles in the reactor was about 0.25 seconds. The product gas contained about 45 weight percent carbon monoxide, about 52 weight percent hydrogen, and about 3 weight percent carbon dioxide. The yield of carbon monoxide was about 0.68 standard liters per hour. This calculates as a conversion of about 22 percent.

EXAMPLE II

This example provides a comparison of the feedability of the feed of Example I with that of a feed comprising a dry mixture of 82 grams of zinc oxide and 15.5 grams of COED coal char particles smaller than 100 U.S.S. mesh.

Each of the feeds were separately charged to the same feed bin and were fed therefrom using the same feed rotor operated at the same rate. A comparison of the amount of feeds fed in ten minute intervals is set forth in the following table.

TABLE

| Grams of Feed Fed in Time Interval | | | | |
|---|---|---|---|---|
| Time Interval, min. | 10 | 20 | 30 | 40 |
| Example I Feed | 6.39 | 6.27 | 6.72 | 6.52 |
| Dry Mix | .24 | .02 | .01 | .09 |

Obviously the inventive feed of Example I fed more smoothly than the dry mix feed. Accordingly, the inventive feed will be more suitable for use with conveying equipment.

Numerous variations and modifications which will become apparent to those skilled in the art after having the benefit of this disclosure can be made without departing from the spirit and scope of this invention.

What is claimed is:

1. A process of producing carbon monoxide comprising heating a carbon-containing feed comprising finely divided particles formed by admixing finely divided particles of solid carbon with a slurry of zinc nitrate, removing enough of the liquid of said slurry to give a solid product, calcining said solid product at a temperature no greater than about 550° C. to convert a substantial portion of the zinc material to zinc oxide, and then comminuting the calcined material to the desired particle size, said heating being sufficient to cause carbon in said feed to be converted to carbon monoxide.

2. A process according to claim 1 wherein said solid carbon is selected from at least one of the group consisting of coal, coke, char, tar sand, peat, oil shale, lignin, and rubber scrap.

3. A process according to claim 2 wherein the finely divided particles of said feed have maximum dimensions of no greater than about 0.4 mm.

4. A process according to claim 3 wherein said feed is heated at temperatures in the range of about 1700° F. to about 2800° F.

5. A process according to claim 4 wherein said aqueous slurry of zinc nitrate is formed by admixing zinc oxide with nitric acid.

6. A process according to claim 5 wherein a surfactant is included in the zinc nitrate slurry.

7. A process according to claim 6 wherein said solid carbon is char.

8. A process according to claim 4 wherein a surfactant is included in the zinc nitrate slurry.

9. A process according to claim 4 wherein ammonium hydroxide is added to the slurry to form a gel.

10. A process according to claim 9 wherein said solid carbon is char.

* * * * *